US006859679B1

(12) United States Patent
Smith et al.

(10) Patent No.: US 6,859,679 B1
(45) Date of Patent: Feb. 22, 2005

(54) METHOD AND APPARATUS FOR PRODUCING A SEWING PATTERN

(76) Inventors: Alexandra K. Smith, 1 Arbor Cir., No. 134, Cincinnati, OH (US) 45255; Mark F. Smith, 1 Arbor Cir., No. 134, Cincinnati, OH (US) 45255

( * ) Notice: Subject to any disclaimer, the term of this patent is extended or adjusted under 35 U.S.C. 154(b) by 0 days.

(21) Appl. No.: 10/314,841

(22) Filed: Dec. 9, 2002

(51) Int. Cl.[7] ..... G06G 7/64; G06G 7/66

(52) U.S. Cl. ..... 700/138; 112/458; 112/475.19; 705/26

(58) Field of Search ..... 700/131, 132, 700/130, 134, 136, 137, 138; 112/470.04, 102.5, 475.19, 470.06, 475.01, 475.08, 475.09; 705/26, 27

(56) References Cited

U.S. PATENT DOCUMENTS 5,937,081 A * 8/1999 O'Brill et al. ..... 382/111
6,196,146 B1 * 3/2001 Goldberg et al. ..... 112/470.04
6,353,770 B1 * 3/2002 Ramsey et al. ..... 700/131
6,564,118 B1 * 5/2003 Swab ..... 700/131

OTHER PUBLICATIONS

Ez–Fit Custom Clothing Patterns, Internet Web Page (www.ez–fit.com) dated Mar. 3, 2002 (9 Pages).

* cited by examiner

*Primary Examiner*—Peter Nerbun
(74) *Attorney, Agent, or Firm*—Mark F. Smith

(57) ABSTRACT

The present invention relates to sewing patterns for use in producing sewn articles whereby a sewing pattern is selected from a collection of patterns. The selected pattern can then be modified as desired and the modified pattern, together with selected fabrics and accessories, can be ordered and delivered to a desired location.

14 Claims, 9 Drawing Sheets

METHOD AND APPARATUS FOR PRODUCING A SEWING PATTERN

BACKGROUND OF THE INVENTION

The present invention relates to sewing patterns, and more specifically to a method and apparatus of providing a sewing pattern for use in producing sewn articles.

Computer-aided techniques have been used in the production process of pattern making in the sewing industry. Specifically, CAD (Computer Aided Design) systems have been used to produce original sewing patterns which are then used to manufacture sewn articles or for producing patterns which are sold through various retail outlets to those interested in producing sewn articles using such patterns. Unfortunately, such patterns are sized to fit standard shapes and the person doing the sewing typically must modify the patterns so that the final sewn article properly fits the object that is being covered or the person who will wear the sewn article. Modifying such patterns may be particularly difficult depending on the complexity of the article to be sewn or the skills of the sewer.

Sewing patterns, such as used by seamstresses and designers for producing articles of clothing, are typically sold in retail stores. Such stores generally maintain numerous standard sewing patterns that cover a wide-range of clothing articles, each pattern being sized to accommodate a small range of sizes. In selecting a pattern, the sewer will review the standard patterns and will select a particular pattern that most closely conforms to the desired article to be sewn. Often, the available standard pattern will not produce the specific article desired and requires substantial modification. Again, this may be difficult as well as time consuming depending on the complexity of the desired changes and the skills of the sewer.

In addition, the desired pattern or the particular size range is often not in stock at a particular location or is not produced by the pattern maker. This is particular true for patterns directed to clothing for children. A child's growing pattern often varies, and a child who is experiencing a slow growth period often is unable to find a pattern that will produce the style of clothing that appeals to the child. In addition, because of the rapidly changing styles desired by children and teenagers, retail stores are reluctant to maintain large inventories of non-traditional patterns that appeal to children and teenagers. Accordingly, pattern makers tend not to develop or produce patterns that produce such clothing.

Once a particular sewing pattern has been selected, the sewer must use his or her imagination to visualize how the final article will appear. It is well known that articles will often appear differently depending on the particular fabric selected, the wearer's or the object's physical attributes, and the fashion accessories selected.

Accordingly, a need exists for a method of supplying articles for sewing, and a method and an apparatus that permits sewing patterns to be easily modified by the sewer, that permits sewing patterns to be inexpensively maintained and produced, that eliminates or reduces the need for retail stores to maintain large amounts of on-site sewing patterns, and that permits the sewer to modify selected patterns to fit non-standard sizes and shapes. A need also exists for a method and apparatus that permits the sewer to easily visualize the final appearance of the article to be sewn.

SUMMARY OF THE INVENTION

The present invention is directed to a method and an apparatus of providing a sewing pattern for use in producing sewn articles. In a preferred embodiment of the invention, the method consists of the steps of selecting a sewing pattern for forming a sewn article from a collection of patterns, modifying the sewing pattern, generating an image of the sewn article to be formed by the modified sewing pattern, approving the modified sewing pattern, and generating a final sewing pattern.

In another preferred embodiment of the invention, the method further includes the step of generating an image of the sewn article that could be formed using the selected sewing pattern.

In another preferred embodiment of the invention, the method includes the step of generating an image of the sewn article to be formed using the final sewing pattern.

In another preferred embodiment of the invention, the method includes the step of selecting a fabric or material for forming the article to be formed using the final sewing pattern.

In another preferred embodiment of the invention, the method includes the step of generating an image of the sewn article to be formed using the final sewing pattern and the selected fabrics and materials.

In another preferred embodiment of the invention, the method includes the step of selecting at least one accessory to be used with the article to be formed using the final sewing pattern and generating an image thereof.

In another preferred embodiment of the invention, the method includes the step of generating an image of the sewn article to be formed using the final sewing pattern together with an image of a selected individual.

In another preferred embodiment of the invention, the method includes the step of storing the final sewing pattern on a computer storage device.

In another preferred embodiment of the invention, the method includes the step of electronically transferring the final sewing pattern from a first location to a remote second location and printing the transferred sewing pattern at the remote second location.

In another preferred embodiment of the invention, the method includes the step of transferring the final sewing pattern from a first location to a remote second location and transferring a printed sewing pattern and a selected fabric to the first location.

In another preferred embodiment of the invention, the method includes the step of electronically inputting and storing sewing patterns into a pattern data bank.

In another preferred embodiment of the invention, the method of generating a sewing pattern includes the step of selecting a sewing pattern for forming a sewn article from a pattern data bank, modifying the sewing pattern using a sewing pattern visualization and modification apparatus, generating an image of the sewn article to be formed by the modified sewing pattern using the sewing pattern visualization and modification sewing pattern apparatus, approving the modified sewing pattern, and generating the final sewing pattern using an output device of the visualization and modification sewing pattern apparatus.

Another preferred embodiment of the invention is a visualization and modification sewing pattern apparatus comprising an input means for selecting an original sewing pattern, means for modifying the original sewing pattern to form a modified sewing pattern, and an image processing means for generating an image of the original sewing pattern and the modified sewing pattern.

In another preferred embodiment of the invention, the visualization and modification sewing pattern apparatus further comprises means for generating a printed sewing pattern.

In another preferred embodiment of the invention, the visualization and modification sewing pattern apparatus further comprises a sewing pattern data bank.

In another preferred embodiment of the invention, the visualization and modification sewing pattern apparatus further comprises means for entering modification data into an object data bank for use in forming modified sewing pattern.

In another preferred embodiment of the invention, the visualization and modification sewing pattern apparatus further comprises means for entering fabric and material information into a fabric data bank.

In another preferred embodiment of the invention, the visualization and modification sewing pattern apparatus further comprises means for entering individual information into a user data bank.

These and other objects and advantages of the invention will be apparent from the following description and the accompanying drawings.

BRIEF DESCRIPTION OF THE DRAWINGS

To provide a more complete understanding of the present invention and further features and advantages thereof, reference is now made to the following description taken in conjunction with the accompanying drawings, in which.

DETAILED DESCRIPTION OF THE INVENTION

Figure 1:
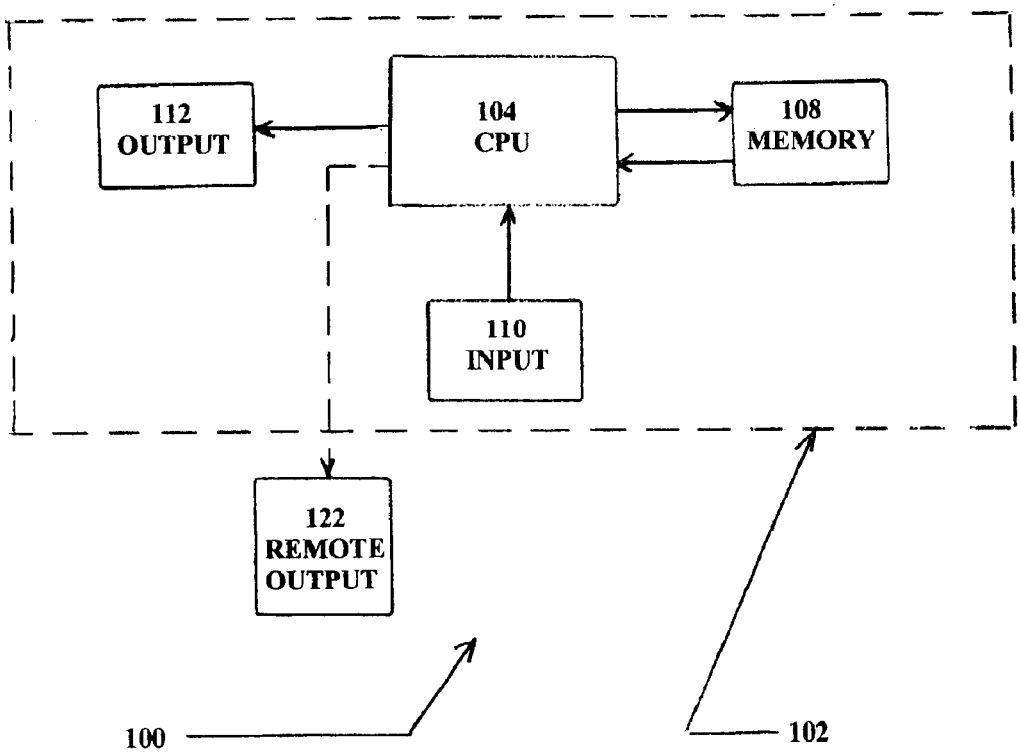
FIG. 1 is a schematic representation of a preferred embodiment of the apparatus for providing a sewing pattern for use in producing sewn objects of the present invention having a computer system for implementing the system software incorporated therein.
Figure 2:
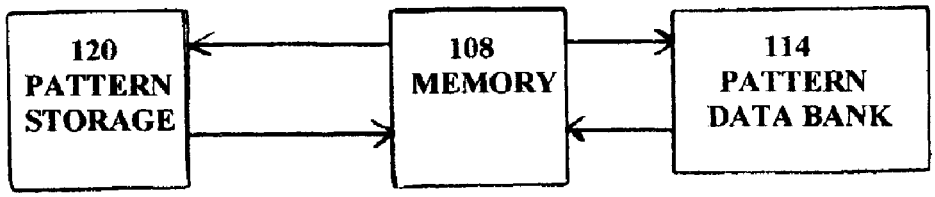
FIG. 2 is a flowchart illustrating the memory inputs by which a sewing pattern can be selected.
Figure 3:
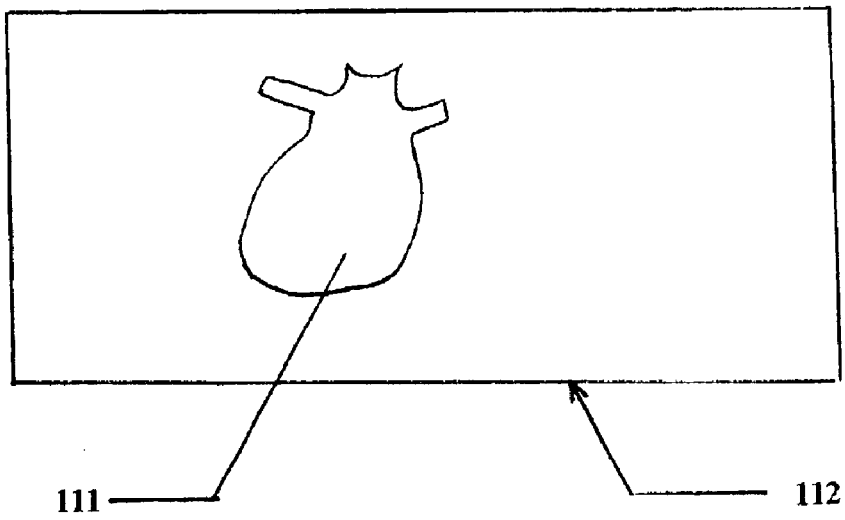
FIG. 3 is an exemplary representation of an output display screen illustrating a selected pattern generated by the system software of the present invention.

The present invention relates to sewing patterns and more specifically to a method and apparatus for providing a sewing pattern for use in producing sewn objects. In describing the preferred embodiments of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose.

Figure 5:
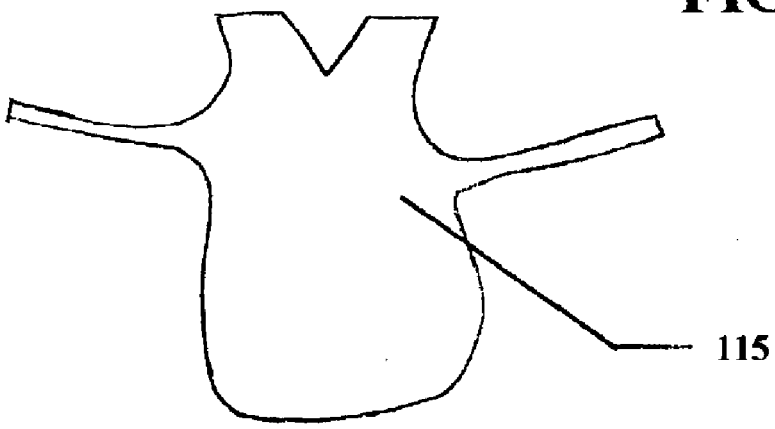
FIG. 5 is an exemplary representation of a final sewing pattern produced by the system software of the present invention.
Figure 6:
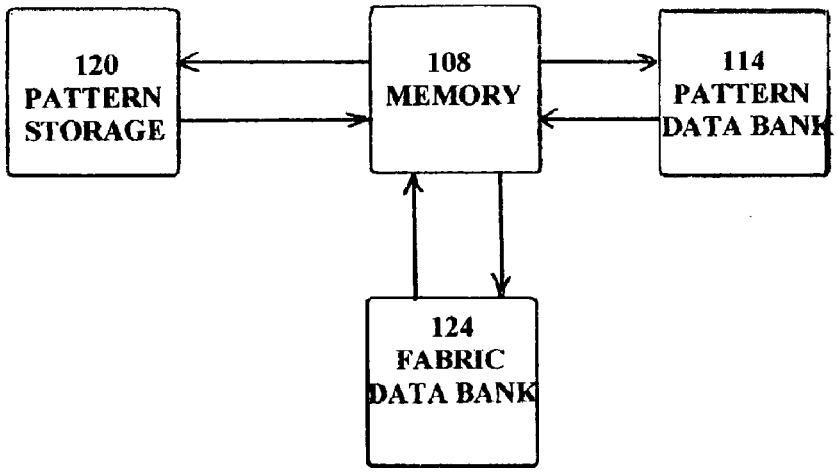
FIG. 6 is an exemplary representation illustrating memory inputs by which a sewing pattern can be selected.
Figure 7:
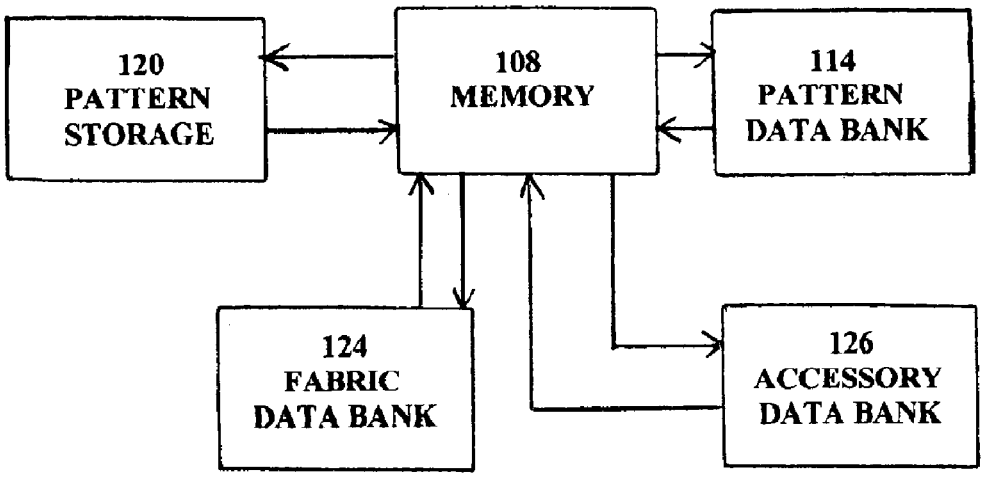
FIG. 7 is an exemplary representation of another embodiment of the invention illustrating memory inputs by which a sewing pattern, fabric and accessory selections may be made.
Figure 8:
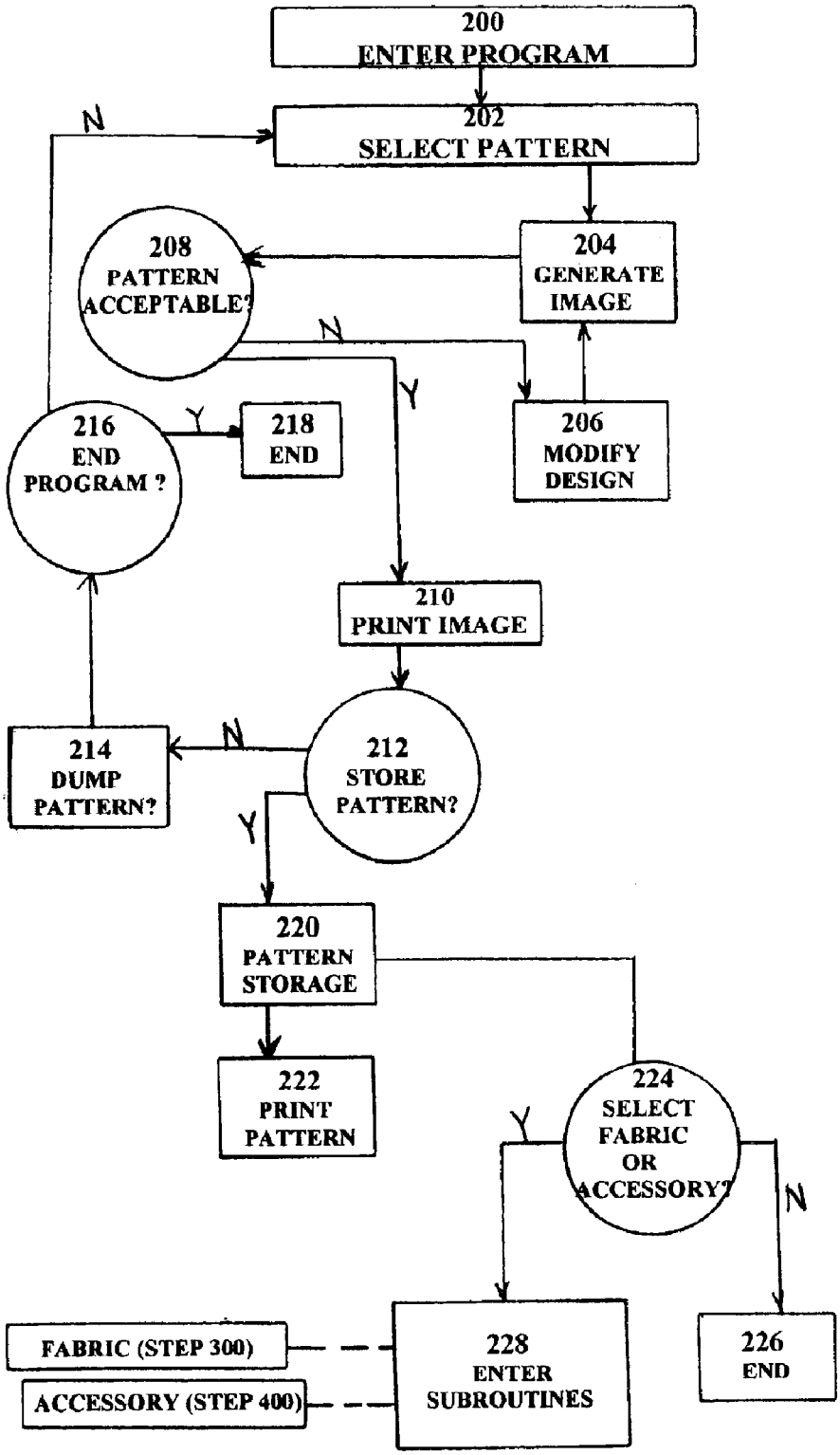
FIG. 8 is a flowchart illustrating another preferred embodiment of the invention showing a preferred process of selecting a sewing pattern.

Referring to FIGS. 1, 5 and 8, a preferred embodiment of the apparatus for providing a sewing pattern for use in producing sewn articles of the present invention 100 is shown comprising a visualization and modification sewing pattern device (VMSPD) 102 having a central processing unit 104 used to implement the system software 106 of the VMSPD 102. The central processing unit 104 includes a memory 108 and may be electronically coupled to other devices, such as a suitable input device 110, like a keypad, touch screen, mouse, cursor, voice recognition unit, or any other suitable input device that can accept information, and one or more suitable output devices 112, such as a computer or electronic display device, printer, projection device, and the like. It should be understood that the VMSPD 102 can include any combination of the above components, or any number of different components, peripherals, and other devices. Preferably, the central processing unit 104 operates under the control of an operating system, such as the WINDOWS™ operating system developed by Microsoft Corporation or the Macintosh™ operating system developed by Apple Computer Corporation. It should be understood, however, that other operating systems could be utilized to implement the system software 106 of the apparatus 100 of the present invention.

The system software 106 is a user or a computer-readable medium having user or computer-readable instructions for performing the method of providing a sewing pattern for use in sewing articles of the present invention. Preferably, the system software 106 is an interactive, menu and event driven system that uses prompt, dialog, and entry windows to guide a user to enter information. As used herein, the term "software" refers to any form of programmed machine-readable language or instructions (e.g., object code) that, when loaded or otherwise installed, provides operating instructions to a machine capable of reading those instructions, such as a computer. The system software 106 of the present invention can be stored or reside on, as well as be loaded or installed from, one or more floppy disks, CD ROM disks, hard disks or any other form of suitable non-volatile electronic storage media. The system software 106 can also be installed by downloading or other form of remote transmission, such as by using Local or Wide Area Network (LAN or WAN)-based, Internet-based, web-based or other remote downloading or transmission methods.

Referring to FIGS. 1–3 and 8, flowcharts illustrating the structured methodology and design of the system software 106 used for implementing the method of the present invention are shown. In a preferred embodiment of the invention, a pattern data bank 114 is provided for electronically storing providing a supply of sewing patterns. The pattern data bank 114 can comprise one or more floppy disks, CD ROM disks, hard disks or any other form of suitable non-volatile electronic storage media which may be inputted and stored in the memory 108 of the central processing unit 104 or may be stored in a separate data base remote from the central processing unit 104 and downloaded, such as by using Local or Wide Area Network (LAN or WAN)-based, Internet based, web-based or other downloading or transmission methods. Individual sewing patterns 111 can be electronically inputted into the memory 106 from the pattern data bank 114.

Figure 4:
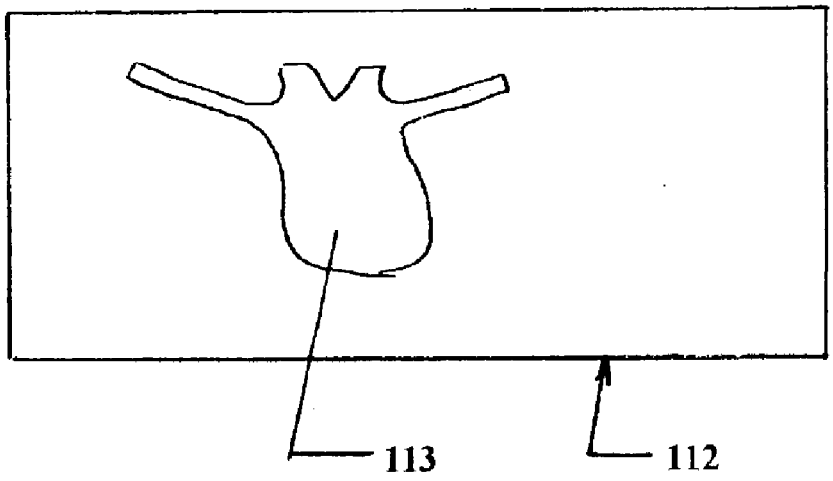
FIG. 4 is an exemplary representation of an output display screen illustrating a modified sewing pattern generated by the system software of the present invention.

Upon entering the system software 106 (step 200), the system software 106 operates by directing the operator to select a sewing pattern (step 202) using the input device 110 of the VMSPD 102 from a plurality of sewing patterns stored in the pattern data bank 114. An image (FIG. 3) of the selected sewing pattern 111 is then generated (step 204) and displayed on the output device 112. The system software 106 then directs the operator to either modify the selected pattern 111 (step 206) using the input device 110 or to accept the selected pattern 111 (step 208). If the selected pattern 111 is to be modified, the modifications can be made to the selected pattern 111 in the form of design modifications using conventional computer aided design methods or in the form of sizing modifications by inputting measurement information or from using previously supplied sizing information stored in the memory 108 (step 212). The system software 106 then operates to generate a modified sewing pattern 113 (FIG. 4) and produces an image (step 210) that can then be displayed on the output device 112. The operator can then accept the modified sewing pattern 113 (step 208) using the input device 110 or can make additional modifications (step 206).

After the operator has accepted either the selected pattern 111 or the modified sewing pattern 113, the pattern 111, 113 the system software 106 directs (step 212) the operator to store the pattern 111, 113 in the memory 108 of the VMSPD 102 or in a separate pattern storage bank 120, such as on one or more floppy disks, CD ROM disks, hard disks or any other form of suitable non-volatile electronic storage media, or to dump the pattern 111, 113 (step 214). If the operator decides to dump the pattern 111, 113, the system software 106 directs the operator (step 216) to either end the program (step 218) or to selected another pattern (step 202) and begin the process over. If the operator decides to store the pattern 111, 113 (step 220), the pattern 111, 113 can also be directed to and a final sewing pattern 115 (FIG. 5) can be printed (step 222) using the output device 112 or an output device 122, such as a conventional printing device, at a remote location (FIG. 1). It should now be apparent to those skilled in the art that the pattern storage device 120 can be used to permit the operator to generate multiple sewing patterns, or permits the operator to print out patterns at various remote locations, such as fabric shops or a pattern or garment fabrication facility.

The final sewing pattern 115 can also be displayed using the system software 106 which operates to conventionally generate a two-dimensional or a three-dimensional image of the article which can be produced by the final sewing pattern 115, using conventional methods, such as taught in U.S. Pat. No. 5,615,318, and incorporated herein by reference.

Referring to FIGS. 1, 5, 6, 8 and 9, in another preferred embodiment of the present invention is shown whereby a fabric data bank 124 for storing information concerning various fabrics and materials suitable for use in the manufacturing of various sewn articles, including, but not limited to, articles such as clothing, garments, draperies, covers, quilts, blankets, and the like is provided. The fabric data bank 124 can comprise one or more floppy disks, CD ROM disks, bard disks or any other form of suitable non-volatile electronic storage media and may be stored within the memory 108 of the central processing unit 104, as shown, or may at a remote location, such as a fabric manufacturer, fabric store, sewing supplier, or at some other similar location. Information concerning a fabric can be inputted into the fabric data bank 124 from any conventional means, such as by one or more floppy disks, CD ROM disks, hard disks or any other form of suitable non-volatile electronic storage media. Fabric information can also be inputted into the fabric data bank 124 by downloading or other form of remote transmission, such as by using Local or Wide Area Network (LAN or WAN)-based, Internet-based, web-based or other remote downloading or transmission methods.

Figure 9:
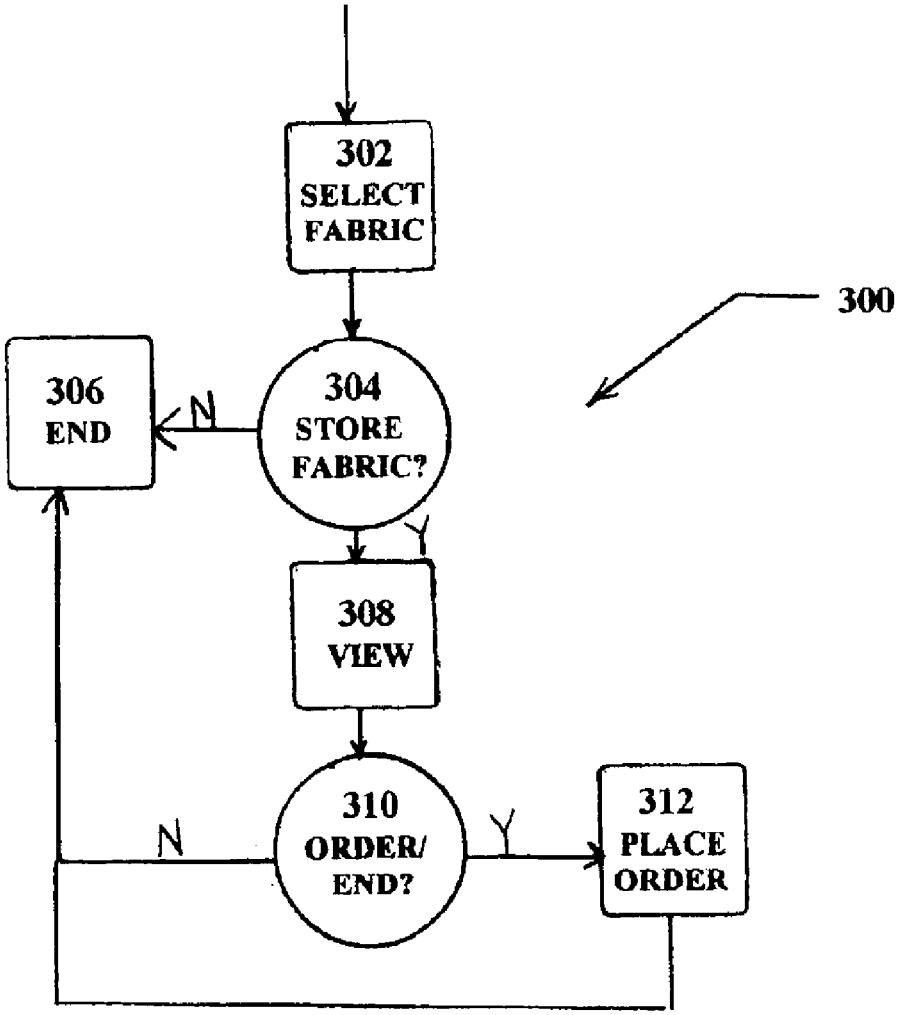
FIG. 9 is a flowchart illustrating another preferred embodiment of the invention showing a preferred process of selecting a fabric.

In operation, after a final sewing pattern 115 has been developed, the system software 106 operates to direct the operator (step 224) to either end the program (step 226) or to enter into the appropriate subroutine (step 228). Referring to FIG. 9, if the operator decides to enter into a subroutine, such as the fabric subroutine (300), the system software 106 permits the operator to review the various fabric and material characteristics stored in the fabric data bank 124 and select one or more fabrics and/or materials (step 302). After the operator has selected a fabric, the system software 106 directs the operator (step 304) to either end (step 306) or to view the selected fabric (step 308) using conventional well-known computer techniques, by superimposing the chosen fabric onto the image of the article that can be produced using the generated final sewing pattern 115. In this way, the operator can easily visualize the appearance of the article that can be formed using the final sewing pattern 115 and the selected fabric and/or material. The system software 106 then directs the operator (step 310) to either place an order (step 312) with a fabric supplier (not shown) or end the program (step 306).

Referring to FIGS. 1, 5, 7, 8 and 10, another preferred embodiment of the present invention is shown whereby an accessory data bank 126 for storing information concerning a plurality of accessories, such as buttons, fringes, shoes, and other similar articles is provided. The accessory data bank 126 can comprise one or more floppy disks, CD ROM disks, hard disks or any other form of suitable non-volatile electronic storage media and may be stored within the memory 108 of the central processing unit 104 or may be at a remote location, such as a fabric manufacturer, fabric sewing supplier, sewing supply store, or some other similar location. Information concerning an accessory can be inputted into the accessory data bank 124 from any conventional means, such as by one or more floppy disks, CD ROM disks, hard disks or any other form of suitable non-volatile electronic storage media. Accessory information can also be inputted into the accessory data bank 126 by downloading or other form of remote transmission, such as by using Local or Wide Area Network (LAN or WAN)-based, Internet-based, web-based or other remote downloading or transmission methods.

Figure 10:
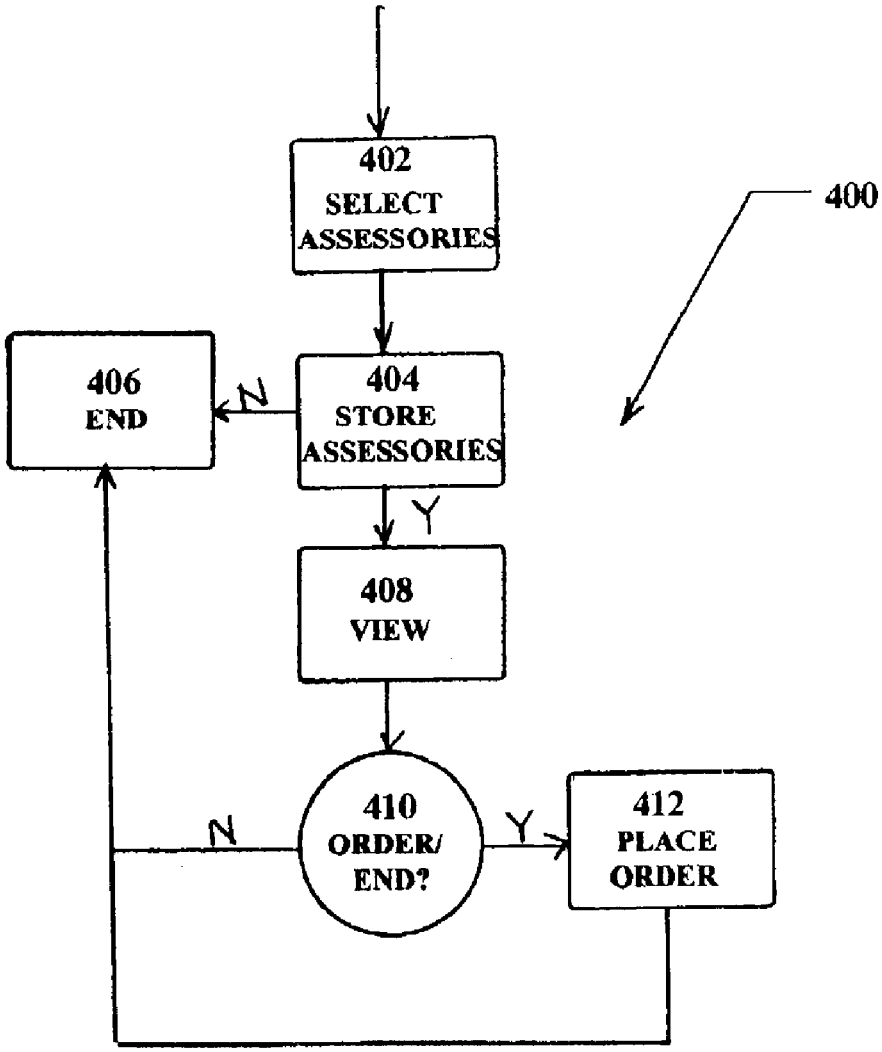
FIG. 10 is a flowchart illustrating another preferred embodiment of the invention showing a preferred process of selecting an accessory.

As previously stated, in operation, after a final sewing pattern 115 has been developed, the system software 106 operates to direct the operator (step 222) to either end the program (step 224) or to enter into the appropriate subroutine (step 226). Referring to FIG. 10, if the operator decides to enter into a subroutine, such as the accessory subroutine 400, the system software 106 directs the operator to select one or more accessories (step 402). After the operator has selected a fabric, the system software 106 directs the operator (step 404) to either end (step 406) or to view the selected accessory (step 408) using conventional well-known computer techniques, by superimposing the chosen accessory onto the image of the article that can be produced using the generated final sewing pattern 115. In this way, the operator can easily visualize the appearance of the article that can be formed using the final sewing pattern 115 and the selected accessory. The system software 106 then directs the operator (step 410) to either place an order (step 412) with an accessory supplier (not shown) or end the program (step 406).

Figure 11:
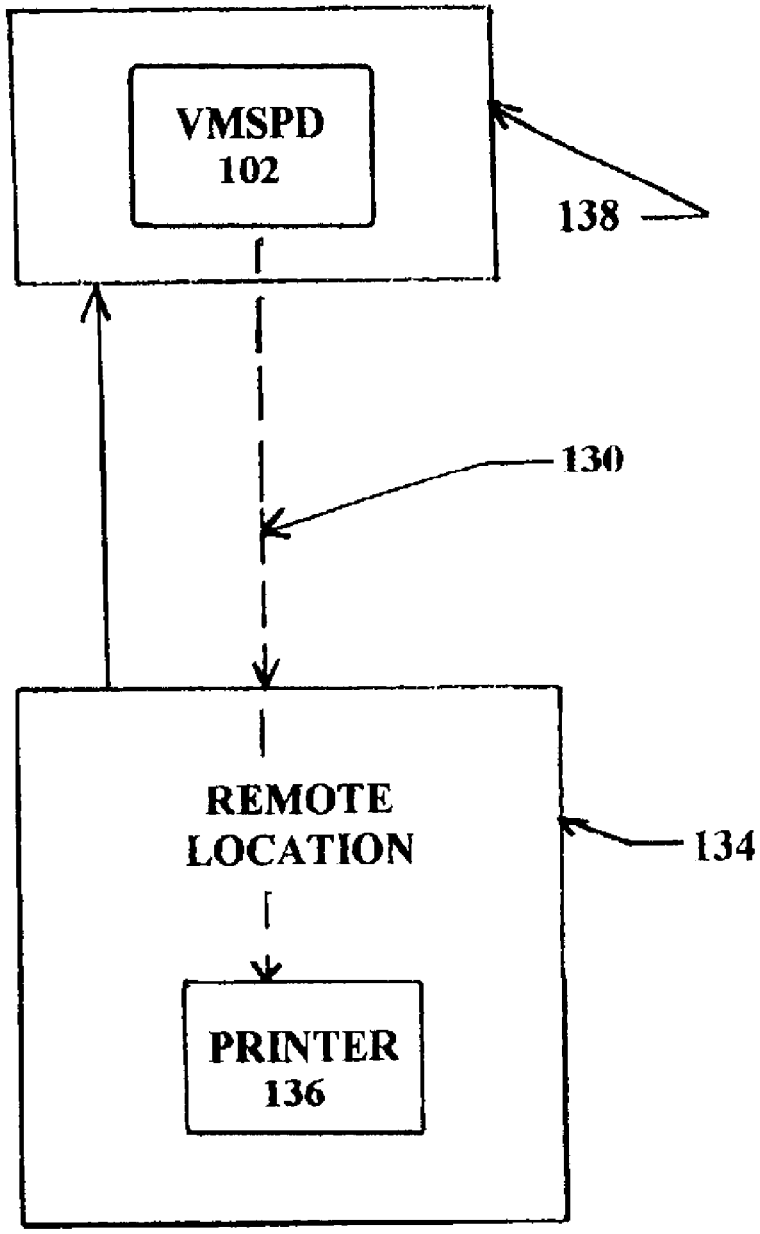
FIG. 11 is an exemplary representation illustrating the flow of information and the commodity delivery method in accordance with the present invention whereby the flow of information is indicated by dotted lines, while the flow of the product delivery is indicated by solid line.

In another preferred embodiment of the invention, as shown in FIGS. 5 and 11, a flow of information and the commodity delivery method is illustrated in accordance with the present invention whereby the flow of information is indicated by dotted lines, while the flow of the product delivery is indicated by solid lines. In this embodiment of the invention, the VMSPD 102 is a home computer system which can be connected to a remote location computer system 128 through a communication channel 130 such as the Internet. It should be understood, however, that the communication channel 130 can be any type of channels connecting two computers together. The operator after producing a final sewing pattern 115 as previously described, electronically transfers the final sewing pattern 115 to a remote location 134, such as a retail fabric store or pattern manufacturer, where the pattern 115 is printed using a conventional remote printer 136. It should now be apparent to those skilled in the art that fabric and material information and accessory information can also be transferred to the remote location 134 or directly to another supplier. Accordingly, the final sewing pattern 115 together with the proper quantity of the selected fabric and material and any selected accessories can be delivered directly to the location 138 of the operator, by any conventional delivery means, such that all of the necessary materials necessary to produce the desired sewn article are received. It should now be apparent to those skilled in the art that the operator can also pay for the sewing pattern and all ordered materials at the same time as placing the order.

In another preferred embodiment of the invention, the apparatus for providing a sewing pattern 100 includes a conventional image scanner (not shown) whereby the operator can scan in an image of an individual whereby the image and critical measurements of the individual is stored in the memory 108. The image together with the measurements are than used by the system software, using conventional well-known computer techniques, to display the image of the article that can be produces using the final sewing pattern 115 as it would appear on the individual.

It should now be understood that the method and apparatus for implementing the method of the present invention permits pattern manufactures to input a plurality of sewing patterns into a pattern data bank that can be accessed by customers, such as by means of the Internet or a computer, at remote locations, such as the customers home or at fabric stores. It should now be apparent to those skilled in the art that such a method and apparatus eliminates or reduces the need for stores selling sewing patterns to maintain large inventories of paper sewing patterns. It should also now be apparent to those skilled in the art that the method and apparatus of the present invention eliminates or reduces the need for stores selling fabric to maintain large inventories of fabric.

It should also be apparent to those skilled in the art that the present invention provides a method and apparatus whereby a sewing pattern can be selected and sized and/or altered as desired; one or more fabrics can be selected; and accessories selected. The pattern together with the proper amounts of fabric(s), that can be calculated by the operator or by the supplier of the fabric, and accessories can then be delivered to the final operator or seamstress. In addition, the present invention permits the supplier to easily manufacture a finished article using the finished sewing pattern and the selected fabric(s) and deliver the finished article to the operator. In this way, the operator can have a properly fitting article formed from a selected fabric or fabrics.

Accordingly the method and apparatus for implementing the method of the present invention permits the selection of a basic pattern from a collection of patterns, the modification of the pattern, and the generation of the modified sewing pattern for use in forming a sewn article; permits a fabric manufacturer to easily and economically market an entire array of fabric without the need of supplying the entire array of fabric to a plurality of retail outlets; permits one to visualize the effect of a modification made to a sewing pattern on a sewn article; permits one to visualize the appearance of an article sewn from various fabrics or fabrics having various color or design patterns; permits one to visualize how a final article will look an a particular person; permits one to visualize the appearance of various accessories used in conjunction with a sewn article. It should also now be apparent to those skilled in the art that the method and apparatus for implementing the method of the present invention permits the operator to select a pattern, modify the pattern, order the final pattern, together with fabric and materials, and selected accessories without having to leave their location.

We claim:

1. A method of generating a sewing pattern for forming a sewn article from a collection of parts comprising the steps of:

from a first location, selecting a sewing pattern from a collection of sewing patterns;

modifying the sewing pattern as desired;

generating an image of the sewn article to be formed by the modified sewing pattern;

selecting a fabric for use with the selected pattern to form the sewn article, the fabric being unsewn and selected from a collection of fabrics;

approving the modified sewing pattern; and from a second location, generating a final sewing pattern and delivering the final sewing pattern and the selected unsewn fabric to the first location for forming the sewn article.

2. The method of claim 1 wherein the visualization and modification sewing pattern apparatus comprising an input means for selecting an original sewing pattern, means for modifying the original sewing pattern to form a modified sewing pattern, and an image processing means for generating an image of the original sewing pattern and the modified sewing pattern.

3. The method of claim 1 wherein the method includes using a visualization and modification sewing pattern apparatus for generating an image of the selected sewing pattern.

4. The method of claim 3 wherein the visualization and modification sewing pattern apparatus further comprises a sewing pattern data bank.

5. The method of claim 3 wherein the invention, the visualization and modification sewing pattern apparatus further comprises means for entering modification data into an object data bank for use in forming a modified sewing pattern.

6. The method of claim 3 wherein the visualization and modification sewing pattern apparatus further comprises means for entering fabric and material information into a fabric data bank.

7. The method of claim 3 wherein the visualization and modification sewing pattern apparatus further comprises means for entering individual information into a user data bank.

8. The method of claim 1 wherein the step of selecting a sewing pattern is performed using the Internet.

9. The method of claim 1 wherein the step of selecting a fabric is performed using the Internet.

10. The method of claim 1 further comprising the step of generating an image of the sewn article to be formed using the final sewing pattern with the image of a selected individual.

11. The method of claim 1 further comprising the step of selecting an accessory from a collection of accessories.

12. The method of claim 1 wherein the collection of sewing patterns is stored in an electronic data bank.

13. The method of claim 1 wherein the collection of fabrics is stored in an electronic data bank.

14. The method of claim 11 wherein the collection of accessories is stored in an electronic data bank.

* * * * *